United States Patent [19]

Sclafani

[11] 4,228,858

[45] Oct. 21, 1980

[54] DRY SPRINKLER WITH NON-LOAD-TRANSMITTING SEALING ARRANGEMENT

[75] Inventor: Joseph R. Sclafani, Greenwich, Conn.

[73] Assignee: The Reliable Automatic Sprinkler Co., Mount Vernon, N.Y.

[21] Appl. No.: 902,288

[22] Filed: May 1, 1978

[51] Int. Cl.[2] ..... A62C 37/12

[52] U.S. Cl. ..... 169/41; 137/72; 239/587

[58] Field of Search ..... 169/37, 38, 39, 40, 169/41, 42, 90; 285/277, 316; 137/72; 239/209, 587

[56] References Cited

U.S. PATENT DOCUMENTS

| | | | |
|---|---|---|---|
| 2,155,990 | 4/1939 | Hodgman | 169/39 |
| 2,180,258 | 11/1939 | Rowley | 169/41 |
| 2,291,813 | 8/1942 | Knight | 169/37 |
| 2,291,818 | 8/1942 | Loepsinger | 169/37 |
| 3,001,586 | 9/1961 | Kyle | 169/2 |
| 3,061,015 | 10/1962 | Cann, Jr. | 169/41 |
| 3,080,000 | 3/1963 | Gloeckler | 169/41 |
| 3,584,689 | 6/1971 | Wilms | 239/583 |
| 4,091,872 | 5/1978 | Mountford | 169/37 |

*Primary Examiner*—David A. Scherbel
*Assistant Examiner*—Fred A. Silverberg
*Attorney, Agent, or Firm*—Brumbaugh, Graves, Donohue & Raymond

[57] ABSTRACT

In the representative embodiments of the invention described herein a dry sprinkler for a fire protection system has a pair of coaxial tubes arranged one inside the other and a plug which seals a fluid passageway formed in a cap at the inlet end of the outer tube to prevent fluid in a supply pipe of the fire protection system from flowing into the sprinkler when the plug is in the passageway. The plug is retained in the passageway against fluid pressure in the supply pipe by a retaining mechanism which releases the plug for automatic expulsion from the passageway by the fluid pressure in the supply pipe when the inner tube moves longitudinally from a first position to a second position.

23 Claims, 5 Drawing Figures

DRY SPRINKLER WITH NON-LOAD-TRANSMITTING SEALING ARRANGEMENT

FIELD OF THE INVENTION

The present invention relates to an automatic sprinkler for fire protection systems, and, more particularly, to such a sprinkler of the dry type. The sprinkler may be used in dry pipe or wet pipe systems.

BACKGROUND OF THE INVENTION

Many, if not all, fire codes require certain types of buildings, structures and areas to be equipped with a safety system used to prevent the spread of fires. Such fire protection systems commonly utilize a network of sprinkler pipes for conducting a fire extinguishing medium, such as water, to a plurality of automatic sprinklers which may be arranged vertically, either in a pendent position or an upright position, or horizontally. Two common types of automatic sprinkler systems are the wet pipe type and the dry pipe type.

In wet pipe systems, the sprinkler pipes are filled with a fire extinguishing medium usually water, and connected to an ample supply of the fire extinguishing medium. Individual sprinkler heads are normally closed, but are designed to open, for instance by the melting of an alloy insert, when the ambient temperature reaches a predetermined value, commonly in the neighborhood of 135°–165° F.

If the system piping is subjected to freezing temperatures, for instance, in unheated buildings, such as warehouses, it may be necessary to employ a dry pipe system, rather than a wet pipe system, to prevent the fire extinguishing medium from freezing in the sprinkler pipes. In dry pipe systems, the sprinkler pipes contain a gas, such as air, rather than a fire extinguishing medium. An ample supply of the fire extinguishing medium is connected to the system by a dry pipe valve, which opens in response to the opening of individual sprinkler heads to permit the gas to escape from the sprinkler pipes and water to enter them and discharge from the sprinkler heads.

Dry automatic sprinklers are known which permit the concealment of dry pipe systems and the extension of sprinkler protection to unheated areas from wet pipe systems. Such sprinklers normally have a valve mechanism at the inlet of a nipple which connects an individual sprinkler head to a supply pipe. When the sprinklers are installed in the supply pipe, the valve mechanism extends into the supply pipe, sealing off the nipple until the sprinkler is activated.

Willms U.S. Pat. No. 3,584,689 discloses such a dry sprinkler which includes an outer tube, an inner tube and a cylindrical sealing chamber affixed to the end of the inner tube adjacent a supply pipe and forming a seal with a cap member in the outer tube. In the embodiment shown in FIGS. 1 and 2 of the Willms patent, the inner tube is urged away from an operative position by a compression spring. In the embodiment illustrated in FIG. 3, the inner tube is urged towards its operative position. However, the cylindrical sealing member of both embodiments remains fixed on the end of the inner tube when the valve is released, requiring water to flow axially between the inner and outer tubes and radially through ports in the sealing member and in the inner tube.

The construction of both embodiments of the dry sprinkler of the Willms patent creates two serious problems. First, forces resulting from fluid pressure in the supply pipe are transmitted to the sprinkler head through the sealing member, the inner tube and the compression spring. If excessive, these forces can cause premature activation of the sprinkler. Second, mixed axial and radial flow of fluid through the sprinkler increases the pressure drop experienced by the flowing fluid. Because flow rate descreases as the pressure drop increases, the inner diameter of the inner tube must be selected, i.e., increased, to compensate for the increase in pressure drop, in order to achieve or maintain a desired or required rate of flow through the sprinkler. Providing a larger diameter inner tube increases manufacturing costs, which are further increased by the provision of ports in the inner tube to permit the entry of fluid passing from the outer tube to the inner tube.

In another known type of dry sprinkler, which has been marketed successfully for many years by the assignee of this application and includes an inner tube, an outer tube and an inlet fitting for attaching the outer tube to a supply pipe, a plurality of sealing balls form a fluid-tight seal at the inlet end of the sprinkler. The sealing balls are held in their sealing positions in the inlet fitting by a ring of locking balls which are maintained in engagement with the outlet end of the inlet fitting and an adjacent sealing ball by the inner tube. Upon the collapse of a heat-responsive device located at the outlet end of the sprinkler, the inner tube moves longitudinally, permitting a generally longitudinal movement of the locking balls which, as a result of such movement, disengage the adjacent sealing ball to permit all of the balls to be ejected from the inlet fitting by fluid pressure in the supply pipe.

By this construction, forces resulting from the fluid pressure in the supply pipe are transmitted to the heat-responsive device through the sealing balls, locking balls, and inner tube, creating the possibility of premature activation. Moreover, if the inner tube expands at a greater rate than the outer tube or inlet fitting when the sprinkler is subjected to above ambient temperatures, the sprinkler can be activated prematurely by the exertion of the heat-responsive device of an additional load resulting from the unequal thermal expansion of the tubes and fitting.

SUMMARY OF THE INVENTION

In accordance with the present invention, there is provided an automatic dry sprinkler which includes an inner tube disposed for longitudinal motion within an outer tube. The end of the outer tube adapted for connection to a fluid supply pipe in a fire protection system includes a fluid passageway. A sealing member is slidably disposed in the passageway and capable of passing through the inner tube when released from the passageway. When the inner tube is disposed in one position adjacent to the passageway, a seal-retaining device, including a plurality of locking members and means supporting the locking members for lateral motion toward and away from the sealing member, cooperates with the sealing member to releasably retain the sealing member in the passageway against fluid pressure in the fluid supply pipe. When the inner tube is in a second position spaced from the passageway, the seal-retaining device permits release of the sealing member from the passageway and ejection from the sprinkler.

In one embodiment, the locking members are balls, each one being disposed for lateral motion in a corresponding generally laterally extending aperture in an inlet cap frictionally maintained in the outer tube and provided with a longitudinal bore which forms the fluid passageway. A portion of each ball is temporarily seated in a laterally depressed portion of the sealing member, which may be a cylindrical plug or spherical ball. Alternatively, the apertures for the balls may be formed in the sealing member, with the inlet cap having a laterally depressed portion which forms a temporary seat for the balls. A ball retainer, moving conjointly with the inner tube, prevents the balls from being completely unseated from the laterally depressed portion of the sealing member or inlet cap until the inner tube moves a predetermined longitudinal distance from the one position toward the second position.

If the sealing member were to become lodged in the bore of the inlet cap after its disengagement from the seal-retaining device, the entire purpose of the sprinkler would be defeated. To avoid this possibility, the sprinkler of the present invention can be provided with an extractor which ensures ejection of the sealing member from the bore of the inlet cap.

By maintaining a spacing between the inner tube and the inlet cap when the inner tube is in the one position, the inner tube can expand thermally without contacting the inlet cap. Thus, the inner and outer tubes may be made of dissimilar metals without imposing an additional load on the sprinkler head assembly, which supports the inner tube in the one position, as a result of unequal thermal expansion of the tubes when they are subjected to above normal ambient temperatures. Preventing premature activation of the sprinkler by forces generated by fluid pressure in the supply pipe and transmitted to the sprinkler head assembly through the inner tube is also eliminated, inasmuch as any such forces transmitted through the sealing member and the locking balls can only act in a radial direction on the ball retainer.

BRIEF DESCRIPTION OF THE DRAWING

For a more complete understanding of the invention, reference may be had to the following detailed description taken in conjunction with the accompanying figures of the drawing, in which.

DESCRIPTION OF EXEMPLARY EMBODIMENTS

Figure 1:
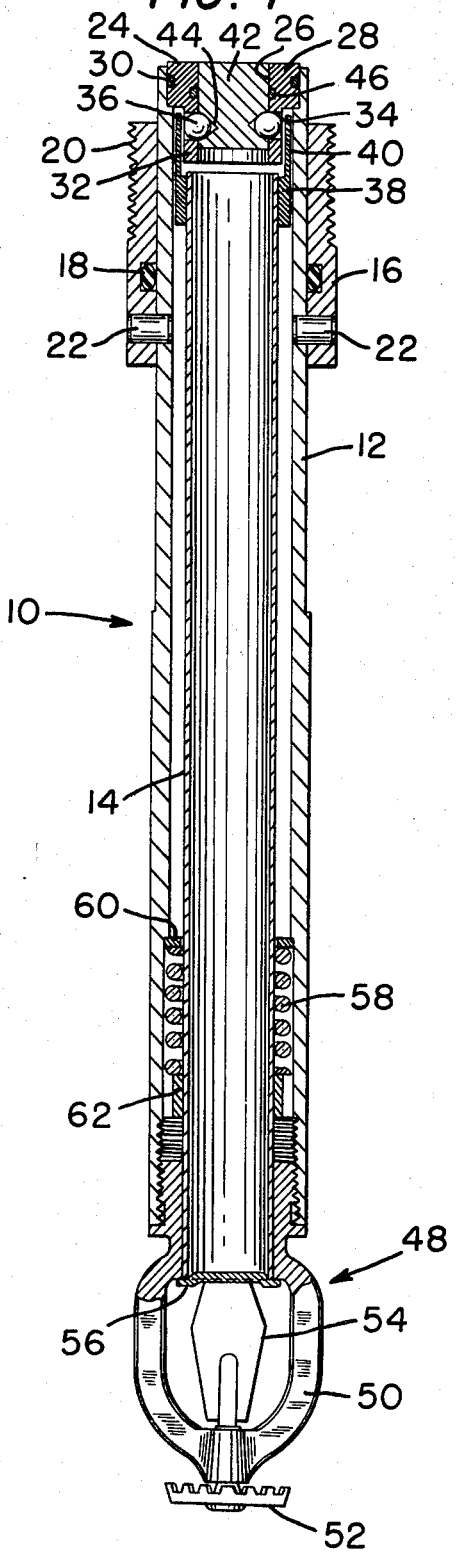
FIG. 1 is a cross-sectional view of one embodiment of the sprinkler of the present invention.

The automatic dry sprinkler 10 illustrated in FIG. 1 of the drawing includes an outer tube 12 and an inner tube 14 disposed coaxially within the outer tube 12. An adapter 16 is press fitted onto the outer tube 12 with an O-ring 18, housed in an annular groove formed in the radially inner circumferential surface of the adapter 16, acting as a seal between the adapter 16 and the outer tube 12. The adapter 16 has external threads 20 for releasably connecting the sprinkler 10 to a supply pipe (not shown) in a wet pipe or dry pipe fire protection system, the supply pipe conducting water or some other suitable fire extinguishing fluid from a source to the sprinkler 10. A plurality of pins 22 nonrotatably fix the adapter 16 to the outer tube 12, each pin 22 extending through radially aligned holes formed in the adapter 16 and in the outer tube 12. The pins also prevent the outer tube 12 from being driven out of the adapter 16 by fluid pressure in the supply pipe.

The end of the outer tube 12 adapted for insertion into the supply pipe is counterbored to receive an inlet cap 24, having a fluid passageway 26 extending axially therethrough. The inlet cap 24 has a large diameter portion 28 which is press fitted into the counterbored inlet or upstream end of the outer tube 12. An O-ring 30, disposed in an annular groove formed in the radially outer circumferential surface of the larger diameter portion 28 of the inlet cap 24, may be used to ensure the formation of a fluid-tight seal between the inlet cap 24 and the outer tube 12.

A small diameter portion 32 of the inlet cap 24 extends from the larger diameter portion 28 axially into the outer tube 12 in spaced relation to the inner surface thereof. A plurality of holes 34 extend radially through the small diameter portion 32 of the inlet cap 24, each hole housing a corresponding ball 36. The diameter of each ball 36 is slightly less than the diameter of its corresponding radial hole 34 in the small diameter portion 32 of the inlet cap 24, so that the balls 36 can pass freely through the holes 34.

One end of a sleeve 38 is press fitted onto the inlet end of the inner tube 14. The other end of the sleeve 38 comprises a projection 40 extending axially along the inner circumferential surface of the outer tube 12 and into the annular space formed between the outer tube 12 and the small diameter portion 28 of the inlet cap 24. When the inner tube 14 is in its normal position, as shown in FIG. 1, the radially inner circumferential surface of the projection 40 engages the radially outermost surface of the balls 36 to prevent them from passing radially outwardly through their corresponding holes 34 in the small diameter portion 32 of the inlet cap 24.

A plug 42, slidably disposed in fluid-tight relation in the fluid passageway 26, has an annular groove 44 positioned adjacent to the holes 34 in the small diameter portion 32 of the inlet cap 24 and normally receiving the portions of the balls 36 which project radially inwardly from the small diameter portion 32. When the balls 36 are seated in the annular groove 44 in the plug 41, they lock the plug 42 in its sealing position in the passageway 26, preventing the ejection of the plug 42 from the fluid passageway 26 by fluid pressure in the supply pipe, thereby blocking the flow of fluid from the supply pipe into and through the outer tube 12 and the inner tube 14. An O-ring 46 is provided in an annular groove formed in the radially inner circumferential surface of the inlet cap 24 to ensure the formation of a fluid-tight seal between the plug 42 and the inlet cap 24.

At the opposite end of the outer tube 12, a sprinkler head assembly 48 is threadedly mounted on the outer tube 12. The sprinkler head assembly 48 has a conventional structure; including a frame 50, a deflector 52, and a heat-responsive device 54 disposed between the deflector 52 and a cap 56 at the opposite end of the frame 50. In its normal, inoperative, position the outlet end of the inner tube 14 extends axially outwardly past the outlet end of the outer tube 12 and abuts the cap 56 so as to maintain the projection 40 adjacent to the radially outer portions of the balls 36, retaining the balls 36 in their locking position in the groove 44. A coil spring 58 extends between a semi-circular washer 60 seated in a counterbore formed at the outlet end of the outer tube 12 and a ring 62 which is press fitted onto the inner tube 14 downstream from the washer 60 and urges the inner tube 14 downwardly against the cap 56.

The outer tube 12 and the adapter 16 can be manufactured from iron or steel. The balls 36 are preferably made of stainless steel. Brass is used to make the inner tube 14.

As a result of the different coefficients of expansion of the inner tube 14 and the outer tube 12 when they are manufactured from dissimilar metals, the relative lengths of the inner tube 14 and the outer tube 12 vary with changes in ambient temperatures. To prevent the unequal thermal expansion of the inner tube 14 and the outer tube 12 from imposing an undesired additional load on the heat-responsive device 54 when the inner tube is in its normal position, thereby increasing the possibility of a premature activation of the sprinkler 10, the projection 40 and the inner tube 14 are dimensioned so as to be spaced from the larger diameter portion 28 and the small diameter portion 32, respectively, of the inlet cap 24. The invention also eliminates the possibility of premature activation of the sprinkler 10 by transmission of forces generated by fluid pressure in the supply pipe to the sprinkler head assembly 48 through the inner tube 14, because any such forces transmitted through the plug 42 and the balls 36 act only in a radial direction on the projection 40.

In operation, when the heat-responsive device 54 reaches its activation temperature, which may, for example be between 135° F. to 165° F., it collapses, releasing the cap 56, which falls away, and permitting the spring 58 to force the inner tube 14 downwardly until the ring 62 abuts the inner end of the frame 50 within the outer tube 12.

As the inner tube 14 moves downwardly from its normal position, the projection 40, which moves conjointly with the inner tube 14, disengages the balls 36 to free them for movement radially outwardly through their corresponding holes 34 in the small diameter portion 32 of the inlet cap 24. The force exerted on the plug 42 by fluid pressure in the supply pipe urges the plug 42 downwardly in the passageway 26 of the inlet cap 24 toward the outlet end of the inner tube 14. The axial movement of the plug 42 forces the unrestrained balls 36 radially outwardly through their corresponding holes 34 in the small diameter portion 32 of the inlet cap 24 and out of their locking position in the annular groove 44 in the plug 42.

Once the balls 36 have completely disengaged the plug 42, the fluid pressure in the supply pipe ejects the plug 42 from the fluid passageway 26 in the inlet cap 24. The diameter of the plug 42 is slightly smaller than the inner diameter of the inner tube 14, so that the plug 42 can pass freely through the inner tube 14. The distance between the end of the inner tube 14 and the frame 15 is great enough to permit the plug to be ejected from the outlet end of the inner tube 14. The balls 36 may also be ejected from the sprinkler 10 through the inner tube 14. The ejection of the plug 42 from the sprinkler 10 provides an unobstructed passageway, permitting the full flow of water or other fire extinguishing fluid from the supply pipe straight through the sprinkler 10, the deflector 52 serving to break up the discharged fluid into an appropriate pattern and droplet size for effective distribution.

Referring now to FIGS. 2–5, there are shown four further embodiments of the present invention. The various elements illustrated in FIGS. 2, 3, 4 and 5 which correspond to elements described above with respect to FIG. 1 have been designated by corresponding reference numerals, increased by 100, 200, 300 and 400, respectively. Unless otherwise stated, all of the further embodiments operate in the same manner as the embodiment of FIG. 1.

Figure 2:
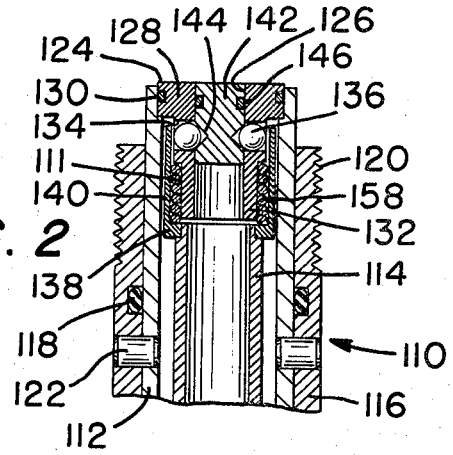
FIGS. 2–5 are cross-sectional views of alternate embodiments of the sprinkler of the present invention.

In the arrangement shown in FIG. 2, the spring 58 of FIG. 1 is replaced by a coil spring 158 disposed inside the projection 140 between the inlet end of the inner tube 114 and a counterbore 111 in the inlet cap 124. In addition, the O-ring 146 is mounted in a groove formed in the radially outer circumferential surface of the plug 142 rather than in the radially inner circumferential surface of the inlet cap 124.

Figure 3:
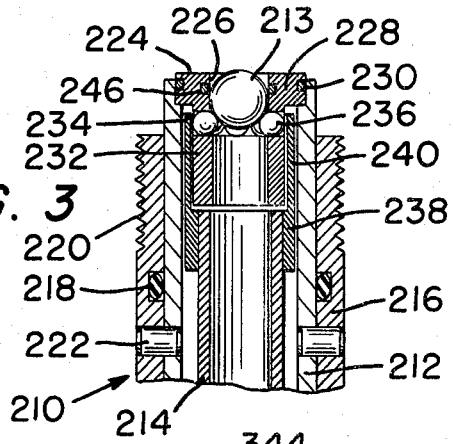

The embodiment of FIG. 3 utilizes a large ball 213, which is slidably disposed and fits closely within the fluid passageway 226 of the inlet cap 224. The ball 213, which replaces the cylindrical plug 42 of the embodiment illustrated in FIG. 1, is positioned so as to compress the O-ring 246 and maintain a fluid-tight seal.

Figure 4:
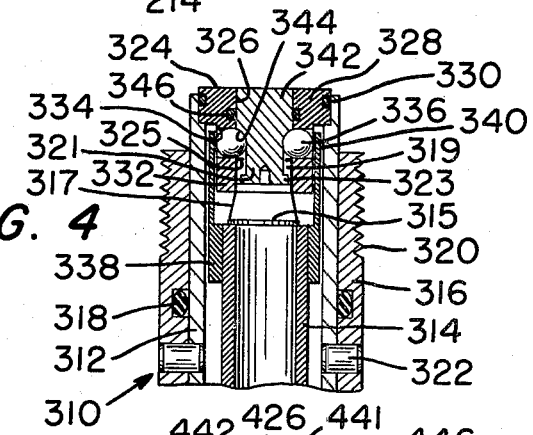

Referring to FIG. 4, to facilitate the ejection of the plug 342 from the fluid passageway 326 formed in the inlet cap 324, there is provided an ejection mechanism including a ring 315 affixed to the inlet end of the inner tube 314. A plurality of spring clips 317 extend substantially axially from the ring 315 through an annular channel 319 formed between the inlet cap 324 and a reduced diameter extension 321 of the plug 342. The extension 321 terminates in a shoulder 323, and a radially inwardly extending finger 325 on the free end of each spring clip 317 is spaced a predetermined distance from the shoulder 323 when the inner tube is in its normal position. As the inner tube 314 moves downwardly during operation, the fingers 325 on the free ends of the spring clips 317 engage the shoulder 323 on the plug extension 321 to overcome any adhesion between the plug 342 and the O-ring 346. When the inner tube 314 has moved downwardly to its lowermost position, the spring clips 317 are below the inlet cap 324 and snap radially outwardly to permit the plug 342 to pass through the inner tube 314.

Figure 5:
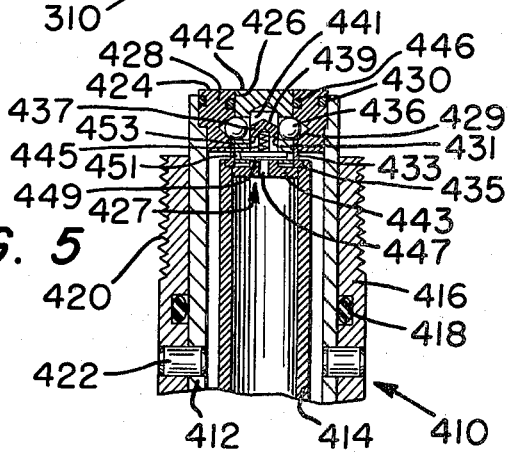

The embodiment of FIG. 5 makes use of an extractor mechanism 427 which also functions as a ball retaining device to replace the projection 40 of the embodiment of FIG. 1. In this embodiment, the inlet cap 424 is formed with an annular groove 429 to receive the outer portions of the locking balls 436 which are received in corresponding lateral openings 431 in the plug 442. A sleeve 433, which is press fitted into the inlet end of the inner tube 414 and has an inner diameter slightly larger than the diameter of the plug 442, provides a downwardly facing shoulder 435 within the inner tube 414.

The extractor mechanism 427 of this embodiment comprises a ball retainer 437, having a conical upper surface 439, slidably received in an axial bore 441 in the plug 442. A disc-shaped enlargement 443 at the lower end of the ball retainer 437 has a diameter larger than the inner diameter of the sleeve 433 so as to abut the shoulder 435. The ball retainer 437 is normally maintained in its ball-retaining position by a small coil spring 445 disposed in an axial blind bore 447 in the ball retainer 437 and extending between the upper end of the ball retainer 437 and a pin 449 inserted in a transverse bore 451 in the plug 442. A longitudinal slot 453 in the ball retainer 437 receives the pin 449 and permits limited longitudinal motion of the ball retainer 437 with respect to the plug 442.

In operation, downward motion of the inner tube 414 and the sleeve 433 moves the ball retainer 437 downwardly against the force of the spring 445, permitting the balls 436 to move inwardly out of engagement with the groove 429. If there is any tendency of the plug 442 to stick to the O-ring 446, it it overcome by the downward motion of the tube 414, sleeve 433, and ball retainer 437 when the upper end of the slot 453 engages the pin 449. Moreover, when the balls 436 are in their inner position they engage the conical upper surface 439 of the ball retainer 437, holding the ball retainer 437 out of its ball-retaining position as long as the balls 436 are held inwardly by the inner surface of the passageway 426, the sleeve 433, and the inner tube 414. As a result, the plug 442 with the balls 436 and the ball retainer 437 can pass freely through the inner tube 414 in response to the pressure of the fire extinguishing medium.

It will be understood that the embodiments described herein are merely exemplary and that persons skilled in the art may make many variations and modifications without departing from the spirit and scope of the invention. For instance, the inlet cap may be threadedly attached to the outer tube, which itself may be provided with external threads for connecting it directly to the supply pipe, thereby eliminating the adapter. Moreover, all of the elements that are described as being press fitted together can be positively attached to any other suitable method or technique, such as soldering, brazing, piercing or pinning. All such modifications and variations are intended to be included within the scope of the invention as defined in the appended claims.

I claim:

1. A dry sprinkler comprising an outer tube adapted for connection at one end to a fluid supply pipe in a fire protection system; an inlet member at said one end of the outer tube; a cap member at the other end of the outer tube; heat-responsive means normally holding the cap member in position at the other end of the outer tube but responsive to an elevated temperature condition to release the cap member therefrom; an inner member disposed in engagement with the cap member and within the outer tube for longitudinal movement relative thereto; said inlet member including means providing a fluid passageway at the end of the outer tube adapted for connection to the fluid supply pipe; sealing means slidably disposed in the fluid passageway for sealing the passageway and capable of passing the inner member when released from the fluid passageway; and seal retaining means responsive to the position of the inner member and cooperating with the sealing means for releasably retaining the sealing means in the passageway against fluid pressure in the fluid supply pipe when the inner member is disposed in one position in engagement with the cap member and permitting release of the sealing means from the passageway to permit ejection from the sprinkler when the cap member is released from the other end of the outer tube and the inner member is in a second position spaced from the sealing means, the seal-retaining means including a plurality of locking members and means supporting the locking members for lateral motion toward and away from the sealing means, the inner member being spaced from the inlet member so as to permit longitudinal motion of the inner member toward and away from the inlet member while the sealing means is retained by the seal-retaining means, thereby preventing transmittal of a load to the cap member by the inner member.

2. A sprinkler as defined in claim 1, wherein the inlet member is an inlet cap positively maintained in the outer tube and the locking members are balls, each of which is disposed for lateral motion in a corresponding generally laterally extending aperture in one of the inlet cap and the sealing means, a portion of each of the balls being temporarily seated in a laterally depressed portion of the other of the inlet cap and sealing means, the seal-retaining means further including ball-retaining means releasably engaging the balls for preventing them from being completely unseated from the laterally depressed portion until the inner member moves a predetermined longitudinal distance from the one position toward the second position.

3. A sprinkler as defined in claim 2, wherein the apertures are formed in the inlet cap and the ball-retaining means is a sleeve, one end of the sleeve being positively attached to the inner member so that the sleeve moves conjointly with the inner member, the other end of the sleeve being positioned substantially adjacent to the apertures in the inlet cap to restrain the balls against movement generally laterally outwardly until the inner member moves the predetermined longitudinal distance.

4. A sprinkler as defined in claim 3, further comprising resilient means disposed in a space formed between the sleeve and a recessed portion of the inlet cap for urging the inner member toward the second position.

5. A sprinkler as defined in claim 4, wherein the resilient means is a coil spring, one end of the spring being connected to the sleeve, the other end of the spring being connected to the inlet cap.

6. A sprinkler as defined in claim 2, wherein the apertures are formed in the sealing means, the apertures communicating with a generally longitudinally extending blind bore in the inner longitudinal end of the sealing means, and the ball-retaining means includes a sleeve, one end of the sleeve having a flange extending laterally outwardly therefrom and positively attached to the inner member so that the sleeve moves conjointly with the inner member, a portion of the sleeve extending laterally into the inner member, and a ball retainer having a shoulder engaging the inner longitudinal surface of the laterally extending portion of the sleeve and a recessed portion extending from the shoulder generally longitudinally into the bore in the sealing means to a position adjacent to the apertures therein for restraining the balls against movement generally laterally inwardly until the inner member moves the predetermined longitudinal distance.

7. A sprinkler as defined in claim 6, further comprising extractor means including a slot extending laterally through the recessed portion of the ball retainer; a pin attached to the sealing means, the pin bridging the bore in the sealing means and passing through the slot in the recessed portion of the ball retainer; and a spring, having one end engaging the outer longitudinal end of the ball retainer and the other end engaging the pin to urge the shoulder of the ball retainer into engagement with the laterally extending portion of the sleeve and the recessed portion of the ball retainer into its ball-retaining position, the slot having a longitudinal dimension such that the outer longitudinal end of the slot engages the pin after the inner member moves a predetermined longitudinal distance from the one position toward the second position for facilitating ejection of the sealing means from the passageway.

8. A sprinkler as defined in claim 1, further comprising resilient means disposed in a space formed between the outer tube and the inner member for urging the inner member toward the second position.

9. A sprinkler as defined in claim 8, wherein the resilient means is a coil spring, one end of the spring being connected to the outer tube, the other end of the spring being connected to the inner member.

10. A sprinkler as defined in claim 1, wherein the inner member, in the one position, is spaced longitudinally from the inlet member a distance sufficient to permit the inner member to expand thermally without contacting the inlet member.

11. A sprinkler as defined in claim 1, wherein the inner member, the outer tube, the inlet member, and the passageway are substantially cylindrical in shape.

12. A sprinkler as defined in claim 11, further comprising an O-ring disposed in a laterally depressed position in the radially inner circumferential surface of the inlet member, the O-ring engaging the sealing means to form a fluid-tight seal between the sealing means and the inlet member.

13. A sprinkler as defined in claim 12, wherein the sealing means is a cylindrical plug.

14. A sprinkler as defined in claim 12, wherein the sealing means is a spherical ball.

15. A sprinkler as defined in claim 12, wherein the laterally depressed portion is an annular groove formed in the inlet member.

16. A sprinkler as defined in claim 11, wherein the sealing means is a cylindrical plug.

17. A sprinkler as defined in claim 16, further comprising an O-ring disposed in an annular groove in the radially outer circumferential surface of the plug, the O-ring engaging the inlet member to form a fluid-tight seal between the plug and the inlet member.

18. A sprinkler as defined in claim 1, further comprising extractor means attached to the inner member and engaging the sealing means after the inner member moves a predetermined longitudinal distance from the one position toward the second position for facilitating ejection of the sealing means from the passageway.

19. A sprinkler as defined in claim 18, wherein the extractor means includes a plurality of spring clips attached at one end to the inner member, the other end of each of the clips extending between the inlet member and the sealing means and having a generally laterally inwardly extending projection for engaging a generally laterally extending shoulder on the sealing means when the inner member has moved the predetermined longitudinal distance.

20. A sprinkler as defined in claim 1, wherein the inlet member is press fitted within the outer tube.

21. A sprinkler as defined in claim 1, wherein the supporting means is independent of the inner member.

22. A sprinkler as defined in claim 1, wherein the inlet member is threadedly connected to the outer tube.

23. A dry sprinkler comprising an outer tube adapted for connection at one end to a fluid supply pipe in a fire protection system; a cap member at the other end of the outer tube; heat-responsive means normally holding the cap member in position at the other end of the outer tube but responsive to an elevated temperature condition to release the cap member therefrom; an inner tube disposed in engagement with the cap member and coaxially within the outer tube for longitudinal movement relative thereto; an inlet cap at the end of the outer tube adapted for connection to the fluid supply pipe, the inlet cap having a fluid passageway extending axially therethrough; sealing means slidably disposed in the fluid passageway for sealing the passageway from fluid flow from the supply pipe when the sealing means is positioned within the passageway and capable of passing through the inner tube when released from the passageway; seal-retaining means mounted in the inlet cap and responsive to the position of the inlet tube for releasably retaining the sealing means in the passageway against fluid pressure in the supply pipe when the inner tube is disposed in one position in engagement with the cap member and permitting release of the sealing means from the passageway to permit ejection from the sprinkler when the inner tube is in a second position spaced from the sealing means, the sealing-retaining means including a plurality of balls, each of which is disposed for lateral motion in a corresponding generally laterally extending aperture in one of the sealing means and the inlet cap, a portion of each of the balls being temporarily seated in a laterally depressed portion of the other of the sealing means and the inlet; and ball-retaining means releasably engaging the balls for preventing them from being completely unseated from the laterally depressed portion until the inner tube moves a predetermined longitudinal distance from the one position toward the second position, the inner tube being spaced from the inlet cap so as to permit longitudinal motion of the inner tube toward and away from the inlet cap while the sealing means is retained by the seal-retaining means, thereby preventing transmittal of a load to the cap member by the inner tube.

* * * * *